United States Patent [19]

Jarvis et al.

[11] 4,124,165

[45] Nov. 7, 1978

[54] FLUID DISCHARGE DEVICE

[75] Inventors: Wilbur W. Jarvis, St. Joseph; Leslie Toth, Coloma, both of Mich.

[73] Assignee: Whirlpool Corporation, Benton Harbor, Mich.

[21] Appl. No.: 753,705

[22] Filed: Dec. 23, 1976

Related U.S. Application Data

[63] Continuation of Ser. No. 644,917, Dec. 29, 1975, abandoned.

[51] Int. Cl.[2] ..... B05B 1/14

[52] U.S. Cl. ..... 239/548; 137/801; 137/562; 239/590.3; 239/553; 239/553.3

[58] Field of Search ..... 68/181 R, 181 D, 208; 134/155; 137/562, 801, 564; 181/35 R, 36 B, 41, 335; 239/589, 590, 591, 553, 602, 548, 552, 553.3, 590.3, 289, 25, 29, 27

[56] References Cited

U.S. PATENT DOCUMENTS

| | | | |
|---|---|---|---|
| 883,176 | 3/1908 | Davis | 181/335 |
| 2,089,224 | 8/1937 | Peterson et al. | 181/35 R |
| 2,717,614 | 9/1955 | Palivos | 239/590.3 |
| 3,105,641 | 10/1963 | Curcio | 239/552 |
| 3,321,140 | 5/1967 | Parkison et al. | 239/553.3 |
| 3,339,587 | 9/1967 | Dicken | 137/562 |
| 3,473,562 | 10/1969 | Ellison | 181/335 |
| 3,559,681 | 2/1971 | Jarvis et al. | 137/594 |
| 3,642,213 | 2/1972 | Parkison et al. | 239/553 |

FOREIGN PATENT DOCUMENTS

| | | | |
|---|---|---|---|
| 194,078 | 1/1908 | Fed. Rep. of Germany | 137/801 |
| 382,667 | 12/1907 | France | 137/801 |
| 69,005 | 7/1915 | Switzerland | 137/801 |
| 439,650 | 12/1935 | United Kingdom | 137/801 |

*Primary Examiner*—James B. Marbert

*Attorney, Agent, or Firm*—Wegner, Stellman, McCord, Wiles & Wood

[57] ABSTRACT

A fluid discharge device such as for use in draining an appliance, such as a dishwasher, into the sink. The discharge device is arranged to prevent splashing of the discharge fluid on the bottom of the sink and includes a divider wall within the discharge duct for dividing the fluid flow into a plurality of streams. The wall may be perforate to further cause a turbulent reduction in the longitudinal velocity of the discharging fluid stream. The duct may be provided with projections extending transversely into the fluid flow to further provide turbulent reduction in the longitudinal velocity of the fluid stream. The discharge device is adapted to be provided in a turned discharge conduit, such as an elbow, and is arranged to provide the desired splash-prevention functioning while yet effectively minimizing obstruction to the fluid flow so as to prevent blockage thereof as by food particles and the like carried by the discharging fluid. The discharge device may be a wall member adapted to be removably installed in an outer end of the discharge duct. In addition to acting as a flow divider, the discharge device further functions as a flow straightener in delivering the fluid therefrom.

17 Claims, 19 Drawing Figures

FLUID DISCHARGE DEVICE

This is a continuation of application Ser. No. 644,917 filed Dec. 29, 1975 now abandoned.

BACKGROUND OF THE INVENTION

1. Field of the Invention

This invention relates to fluid flow systems and in particular to means for providing substantially splash-free discharge of fluid.

2. Description of the Prior Art

In one form of flowing and drain coupler means for supplying water to and draining water from an appliance, such as a dishwasher, disclosed in U.S. Pat. No. 3,559,681 of Wilbur W. Jarvis et al., owned by the assignee hereof, a coupler is provided for attachment to a sink faucet or the like so as to direct a discharge outlet downwardly toward the sink bottom. The discharge portion is defined by a curved elbow through which the fluid may flow in a rapidly flowing stream.

Another form of fluid discharge device is shown in U.S. Pat. No. 2,075,867 of Henri Sampel, to comprise a cement gun nozzle having a plurality of kneading, or massaging, fingers, or mixing elements. The mixing elements define means for converting linear motion of a wet stream of cement aggregate into rotary motion first in one direction at one place in the chamber and then in an opposite direction at another place in the chamber for thoroughly combining or impregnating the cement with the water to promote better hydration thereof.

In U.S. Pat. No. 2,871,871 of George D. Conlee, a water supply means for washing machines is shown having a shield structure provided with foraminate members positioned to intercept the jet stream and act to break it up into a multiplicity of finely divided streams. The openings in the foraminate member open generally in the direction of the stream flow and the flatwise extent of the foraminate members is transverse to the flow direction.

Michael Curcio, in U.S. Pat. No. 3,105,641, discloses an anti-splash gasoline pump nozzle adapted having a plurality of interlocking baffle walls to divide the gasoline stream into a plurality of streams for allowing air to pass upwardly between the streams thereby to preserve an air space within the gasoline tank.

William Stein et al., in U.S. Pat. No. 2,367,809 show a spout of the type employed in sinks, bathtubs and lavatories having a sheet metal flow diffusing element defined by a plurality of vanes radiating from a central core portion. The element is inserted in the discharge opening of the spout.

John K. Lyon, in U.S. Pat. No. 3,312,402, shows a tub filler-type pulling fixture having a right angle spout with a projecting wall bisecting the incoming water stream so that the upper part of the stream remains behind the wall and the lower portion of the stream passes beyond the wall. The stream is deflected downwardly and transversely with respect to the inlet orifice to entrain air and intermingle with the remaining stream to produce an aerated stream at the lower end of the fixture.

William A. Eckerle, in U.S. Pat. No. 3,529,775, shows a discharge device for an automatic washing machine having a substantially open effluent discharge means with one of the walls defining the outlet chamber comprising a substantially planar, vertically disposed impact wall. By the disclosed arrangement, fluid entering the chamber through the inlet opening strikes the impact wall and reflects toward the opposite wall so as to form the stream into a columnar stream for discharge at a relatively low velocity through the outlet opening.

Tom W. Johnson et al., in U.S. Pat. No. 3,796,380, disclose a molded plastic plumbing fixture wherein the discharge passage is formed by a fluted, or finned, mold core and thereby contains a plurality of radially inwardly projecting molded fins serving to guide the water flowing from the discharge passage and smoothing the flow of a stream of water emerging from the spout.

SUMMARY OF THE INVENTION

The present invention comprehends an improved discharge device for use in a fluid flow system and more specifically for discharging a stream of fluid from such a fluid flow system so as to prevent splashing thereof upon impingement of the discharge stream with a wall surface, such as the bottom wall of a sink.

More specifically, the present invention comprehends such a discharge device having a wall element provided with a plurality of through openings mounted in the discharge duct of the fluid flow system with the wall element extending longitudinally in the duct and with the openings opening substantially transversely to the duct.

The transversely opening wall openings act on the fluid stream to cause a turbulent reduction in the longitudinal velocity of the discharging fluid stream.

The duct wall may further define a plurality of inwardly extending projections cooperating with the wall element in causing the turbulent reduction in the longitudinal velocity of the fluid stream.

In the illustrated embodiment, the wall element is removably carried in the duct.

The wall element may comprise a plurality of walls extending transversely across the duct. In one form, the wall means defines a cruciform cross section. The wall means may be made up of a plurality of separate wall elements. Alternatively, the wall means may be formed from a plurality of wall portions joined by flexible connecting means.

In the illustrated embodiment, the wall means is formed of molded synthetic resin. Further in the illustrated embodiment, the duct is formed of molded synthetic resin with the projections formed integrally therein. The openings in the wall may be distributed over substantially the entire flatwise extent thereof.

In the illustrated embodiment, the discharge device is utilized in a dishwasher appliance wherein the fluid inducted by the discharge device may comprise dish-treating liquid carrying a substantial amount of suspended particulate material, with the configuration of the discharge device being adapted to prevent clogging of the discharge duct by such material.

Thus, the discharge device of the present invention is extremely simple and economical of construction while yet providing the highly desirable features as discussed above.

BRIEF DESCRIPTION OF THE DRAWING

Other features and advantages of the invention will be apparent from the following description taken in connection with the accompanying drawing wherein.

DESCRIPTION OF THE PREFERRED EMBODIMENTS

Figure 1:
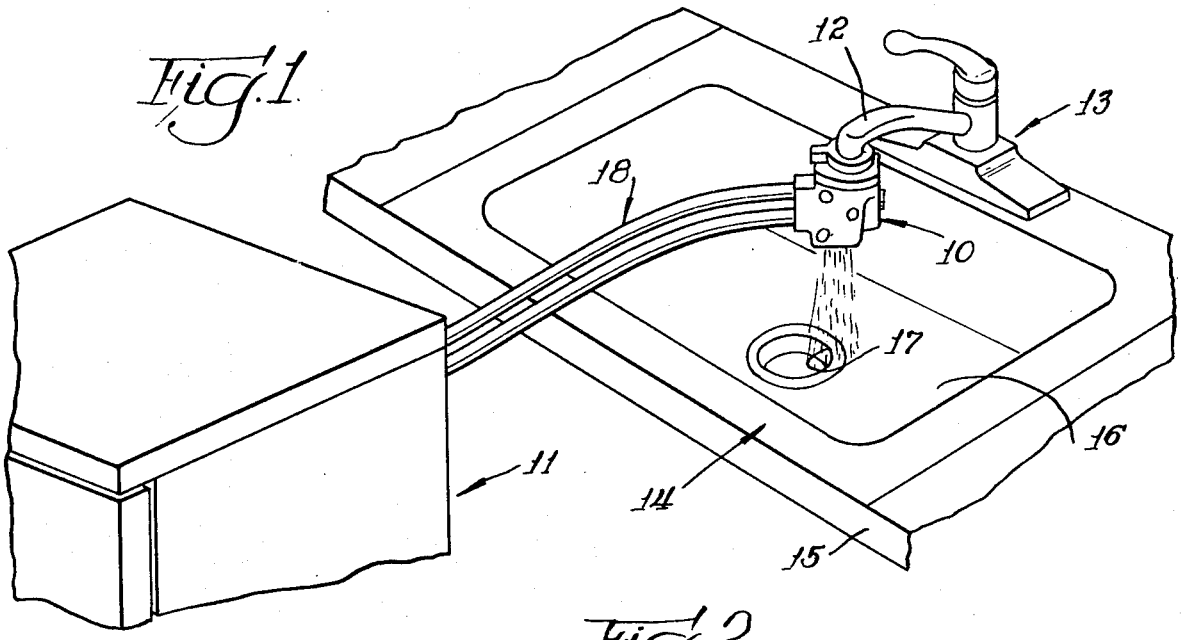
FIG. 1 is a fragmentary perspective view of a flow device embodying the invention installed on a spout of a kitchen sink and connected to a portable dishwasher appliance.

In the exemplary embodiment of the invention as disclosed in the drawing, a coupler, or discharge device, generally designated 10 is provided for use in filling and draining an appliance, such as a dishwasher appliance, generally designated 11. The coupler is adapted to be mounted on the faucet 12 of a conventional fixture 13 as may be provided in a conventional kitchen sink 14. In the illustrated embodiment, sink 14 is adapted to be mounted in a conventional counter 15 and defines a bottom wall 16 having a drain opening 17.

The coupler 10 is generally of the type shown in the above-identified U.S. Pat. No. 3,559,681 of Wilbur W. Jarvis et al., owned by the assignee hereof, to which patent reference may be had for a more detailed disclosure of the functioning of such couplers in connection with portable appliances, such as portable dishwashers. The present invention is concerned with an improved structure in such a coupler for effectively minimizing splashing of the fluid delivered from the coupler downwardly against the sink bottom wall 16 as in a draining operation. The discharge problem is aggravated in the conventional drain conduit of such a coupler in that a turned end portion, or elbow portion, is conventionally required to direct the discharging fluid from the generally horizontal direction required by the connecting lines 18 to the downward direction for impingement on the bottom wall 16. It is also necessary to effectively preclude clogging of the discharge device by particulate, or similar solid matter carried in the fluid being drained from the dishwasher and, thus, as shown in the above-identified Jarvis et al., patent, such discharge conduits are conventionally arranged to be relatively free of any obstructions to the free discharge flow.

Figure 2:
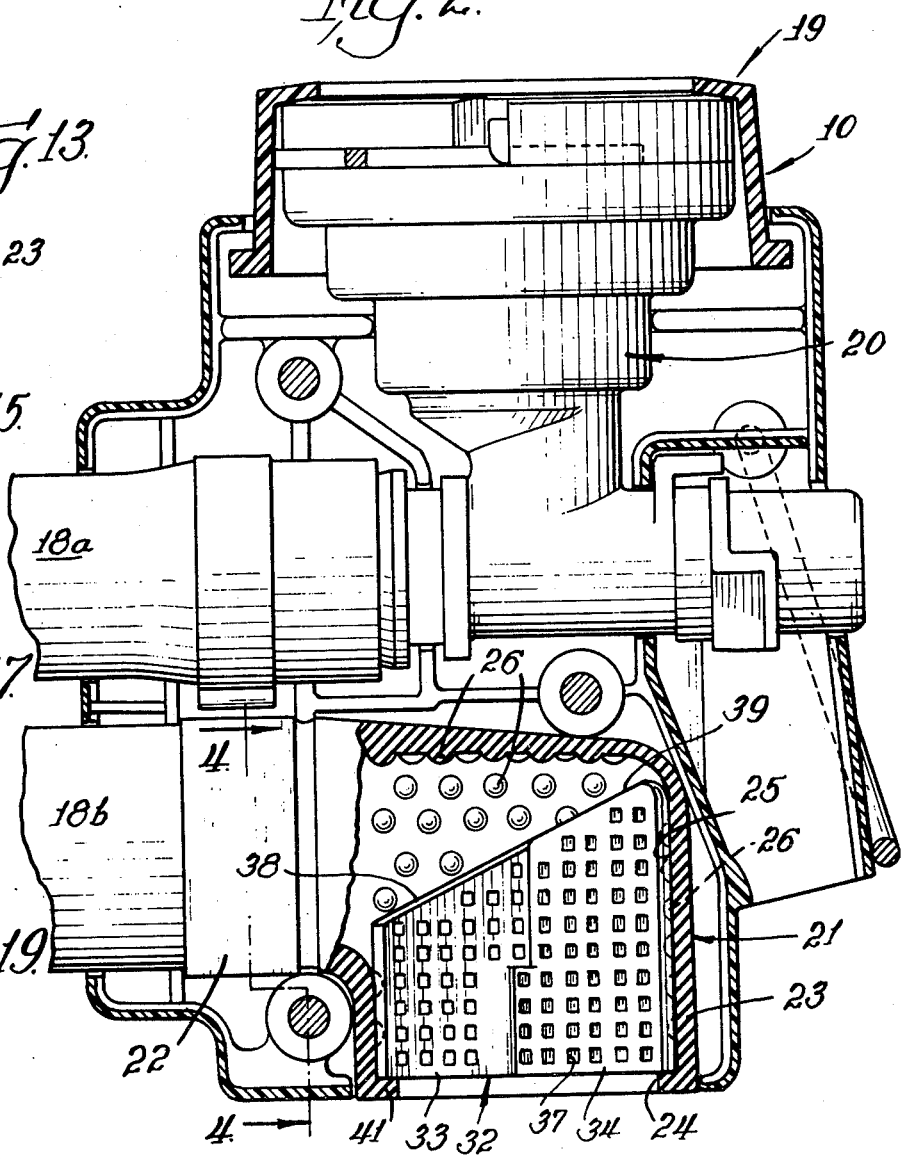
FIG. 2 is a fragmentary vertical section with portions broken away of the flow device.

Referring now more specifically to FIG. 2, coupler 10 is shown to include a connecting portion generally designated 19 adapted to be removably connected to the faucet 12. The coupler includes a first duct portion 20 for conducting water from the faucet through a delivery hose **18*a* of hoses 18 to the appliance 11. The coupler further includes a tubular duct portion generally designated 21 for receiving drain fluid along a longitudinal extent from the appliance 11 through a return hose 18*b* of hoses 18. The discharge duct portion 21 may be formed integrally with hose 18*b* or may comprise a separate element sealingly secured thereto as desired. As shown in FIG. 2, the discharge duct portion 21 defines an elbow having a first portion 22 extending from hose 18*b* and a distal turned end portion 23 extending substantially perpendicularly to portion 22 and defining the outlet opening 24 through which the drain fluid is discharged from the coupler. As shown in FIG. 2, the duct portion 21** may comprise a molded synthetic resin means.

Figure 12:
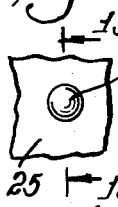
FIG. 12 is an elevation of one form of projection means on the discharge duct.
Figure 13:
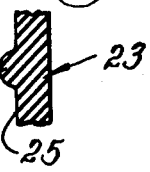
FIG. 13 is a fragmentary section thereof taken substantially along the line 13—13 of FIG. 12.

The inner wall surface 25 of duct portion 21 may be provided with a plurality of inwardly projecting bosses 26. As shown in FIGS. 12 and 13, the bosses may comprise semi-spherical bosses. The inwardly projecting bosses effectively define means for creating a liquid turbulence in the discharging fluid which results in a reduction of the velocity thereof which has been found to be highly efficient in the prevention of splashing of the fluid upon impingement with the sink bottom wall 16, as illustrated in FIG. 1.

Figure 14:
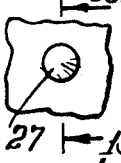
FIG. 14 is a fragmentary elevation of another form of projection means.
Figure 15:
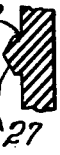
FIG. 15 is a fragmentary section thereof taken substantially along the line 15—15 of FIG. 14.
Figure 16:
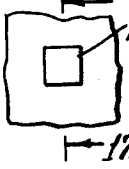
FIG. 16 is a fragmentary elevation of still another form of projection means.
Figure 17:
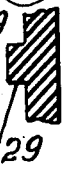
FIG. 17 is a fragmentary section thereof taken substantially along the line 17—17 of FIG. 16.
Figure 18:
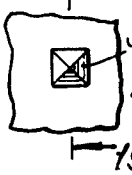
FIG. 18 is a fragmentary elevation of yet another form of projection means.
Figure 19:
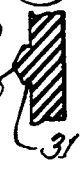
FIG. 19 is a fragmentary section thereof taken substantially along the line 19—19 of FIG. 18.

The projecting bosses may alternatively have configurations other than the semispherical configuration of FIGS. 12 and 13, and illustratively may alternatively have a frusto-conical outer portion 27 surmounting a cylindrical inner portion 28, as illustrated in FIGS. 14 and 15. Further alternatively, the projections may have a rectangular cross section, as illustrated in projections 29 of FIGS. 16 and 17. Further alternatively, the projections may have pyramidal outer portion 30 surmounting a rectangular cross section inner portion 31, as illustrated in FIGS. 18 and 19. As will be obvious to those skilled in the art, other suitable projection configurations may by utilized within the scope of the invention to provide the desired turbulent reduction in the discharge velocity of the discharging fluid.

Figure 3:
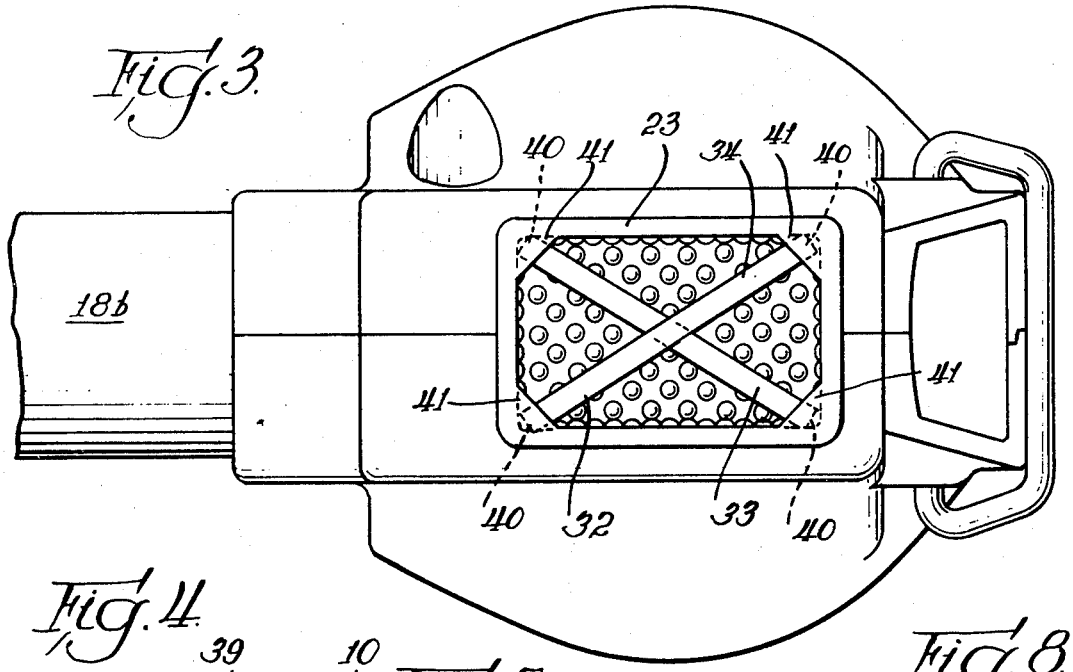
FIG. 3 is a bottom plan view thereof.
Figure 6:
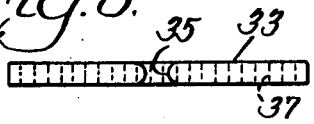
FIG. 6 is a bottom plan view thereof.
Figure 8:
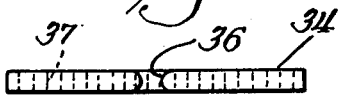
FIG. 8 is a top plan view thereof.
Figure 7:
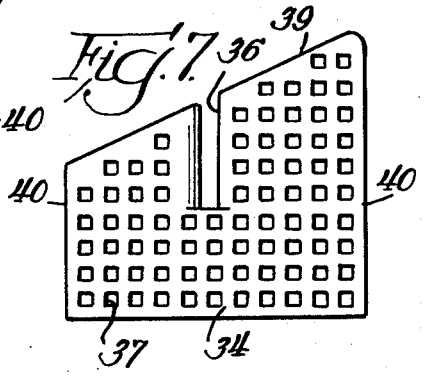
FIG. 7 is a side elevation of a second wall element of the discharge device.

The invention comprehends the provision of a removable wall means generally designated 32 in the discharge duct portion 21. In the embodiment of FIGS. 2–8, the wall means is defined by a pair of wall elements 33 and 34 which are interlocked to define a cruciform cross section, as best seen in FIG. 3. More specifically as seen in FIGS. 5–8, wall element 33 includes a downwardly opening slot 35 and wall element 34 includes an upwardly opening slot 36. As shown in FIGS. 6 and 8, each of the wall elements comprises a flat element. Each of the wall elements may be provided with a plurality of apertures 37 which, as shown in FIGS. 6 and 8, open perpendicularly through the flat walls. Wall element 33 defines an inclined, upper edge 38 and wall element 34 defines a corresponding inclined upper edge 39.

As seen in FIG. 3, downturned end portion 23 of the discharge duct portion 21 may be generally rectangular in cross section. Wall elements 33 and 34 are preselected to have a width substantially equal to the corner-to-corner diagonal dimension of the duct portion 23 so that when the wall elements are interlocked in the cruciform configuration of FIG. 3 and installed in the duct portion 23, the side edges 40 thereof frictionally engage the corners of the duct portion 23 to removably retain the wall means 32 in the desired cruciform configuration within duct portion 23. To further retain the wall means 32 therein, the distal end 41 of the duct portion 23 defining opening 24 may be inturned to define a flange underlying the wall means at each of the corners of the duct portion 23.

Figure 4:
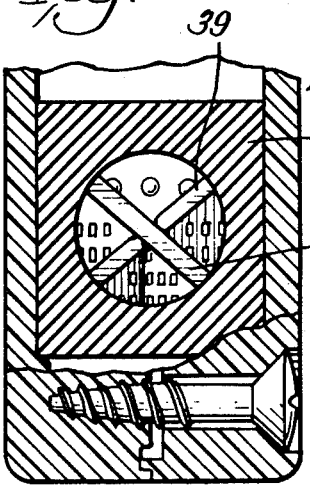
FIG. 4 is a fragmentary vertical section taken substantially along the line 4—4 of FIG. 2.
Figure 5:
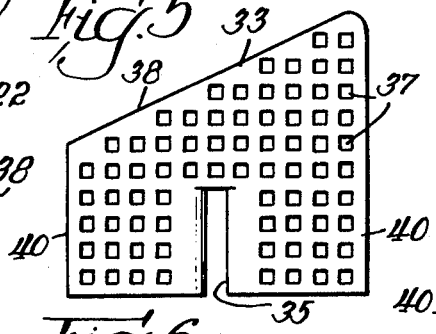
FIG. 5 is a side elevation of one wall element of the discharge device.

As best seen in FIG. 2, the inclined edges 38 and 39 of the wall elements 33 and 34 are inclined to the longitudinal extent of the hose 18*b* and inlet portion 22 of the duct 21. As shown in FIG. 4, the edges 38 and 39 define a cruciform configuration looking from the hose 18*b*. Thus, the wall means 32 effectively divides the effluent stream into four separate portions prior to discharge through opening 24. The dynamic action of the transversely extending apertures 37 in the wall elements and the dynamic action of the projections 26 (27–31) each serve to create a liquid turbulence which results in a reduction in the discharge velocity of the effluent liquid. The angled arrangement of the edges 38 and 39 facilitates the turning of the effluent stream in the elbow portion 21.

It has further been found that the stream-dividing wall means effects a desirble flow straightening action further controlling the delivery of the effluent against the sink bottom wall 16, as shown in FIG. 1.

The wall means 32 may be readily installed and removed from the discharge device for facilitated service and maintenance. As the wall means may be formed of molded synthetic resin, the wall means is extremely simple and economical of construction while yet providing the improved flow control functioning discussed above.

Figure 9:
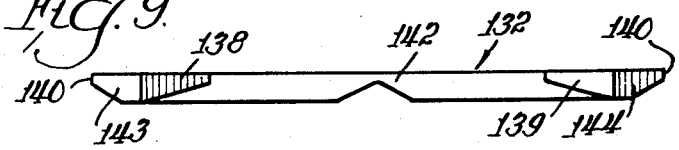
FIG. 9 is a top plan view of a modified form of discharge device embodying the invention.
Figure 11:
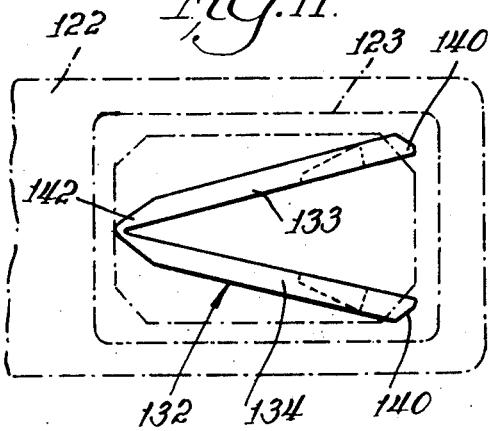
FIG. 11 is a bottom plan view thereof illustrating the mounting thereof in the discharge duct, with the discharge duct being shown in broken lines.
Figure 10:
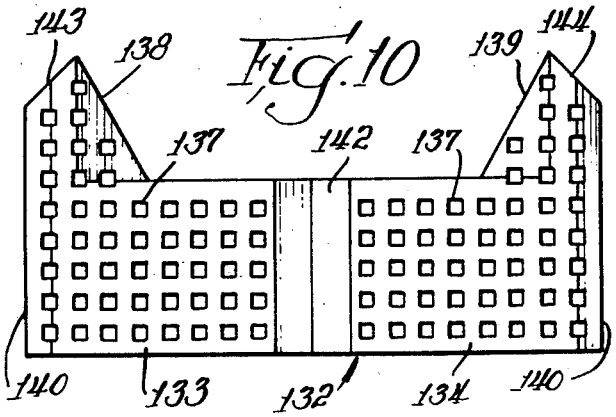
FIG. 10 is a side elevation thereof in the unfolded arrangement.

Referring now to the embodiment of the wall means shown in FIGS. 9–11, a modified form of wall means generally designated 132 is shown to comprise a first wall portion 133 and a second wall portion 134 integrally joined by a hinged connecting portion 142. Wall portion 133 is defined by an inclined upper edge 138 and wall portion 134 is defined by an inclined upper edge 139 extending only partially across the width of the wall portions. Additionally, edge 138 may include a downturned outer portion 143 and edge 139 may include a complementary downturned outer portion 144 extending to the outer vertical edges 140 of the element 132.

Each of the wall portions 133 and 134 may be provided with a plurality of distributed apertures 137 extending substantially over the entire flatwise extent thereof.

Dividing wall means 132 may be installed in the discharge device as shown in FIG. 11 by folding the connecting portion 142 so as to dispose the wall portions 133 and 134 angularly to each other with the outer edges 140 engaging the outer corners of the duct portion 123 and with the connecting portion 142 substantially bisecting the duct portion 123 at the entrance thereto from duct portion 122.

Dividing wall means 132 function similarly to dividing wall means 32 in the flow discharge device in providing the highly desirable creation of liquid turbulence in the stream resulting in a reduction in the discharge velocity thereof. At the same time, the dividing wall means 132 effectively break up the stream into a plurality of separate streams and functions as flow straightening means in providing an effectively splash-free delivery of the effluent from the discharge device against the sink bottom wall 16, as shown in FIG. 1.

Dividing wall means 132 may be readily installed and removed relative to the discharge device for facilitated service and maintenance and similarly to dividing wall means 32, may be formed of molded synthetic resin whereby the dividing wall means 132 is extremely simple and economical of construction.

Each of the dividing wall means 32 and 132 provides effectively minimum obstruction to the passage of particulate matter and the like carried in the effluent so as to effectively avoid clogging of the discharge device by such material in the normal use thereof. As the openings in the dividing wall means open substantially transversely to the longitudinal direction of the fluid stream, they are maintained effectively unblocked by the washing action of the fluid stream tending to carry away any particulate matter which may impinge on the wall means at the openings 37 and 137. Thus, the discharge device is effectively self-cleaning, providing minimizing of maintenance requirements and facilitating the use of the washing appliance.

The foregoing disclosure of specific embodiments is illustrative of the broad inventive concepts comprehended by the invention.

We claim:

1. In a fluid flow discharge duct for discharging a stream of fluid, an improved discharge control device comprising a wall extending transversely across said duct and having a plurality of openings therethrough, said openings being distributed over a major area of the wall, said wall extending longitudinally in the duct with said openings opening transversely to the duct, said wall concurrently dividing the fluid flow through the duct and cooperating with the duct to direct the fluid outwardly from the duct in a discharge stream, the wall openings being arranged to act on the fluid in the duct to cause a turbulent reduction in the longitudinal velocity of the discharging fluid stream.

2. The fluid discharge device of claim 1 wherein said duct defines a turned elbow terminating in a straight distal end portion, said wall being disposed in said distal end portion.

3. The fluid discharge device of claim 1 wherein said openings open perpendicular to said longitudinal extent of the discharge duct.

4. The fluid discharge device of claim 1 wherein said wall is removably carried in said duct.

5. The fluid discharge device of claim 1 wherein said wall extends flatwise parallel to said longitudinal extent of the discharge duct.

6. The fluid discharge device of claim 1 wherein said wall extends flatwise parallel to said longitudinal extent of the discharge duct and fully transversely thereacross.

7. The fluid discharge device of claim 1 wherein said wall is cruciform in cross section transversely to said longitudinal extent of the discharge duct adjacent said wall.

8. The fluid discharge device of claim 1 wherein said wall comprises a pair of wall portions joined by a hinge portion.

9. For use in a fluid flow system for discharging a stream of fluid, an improved discharge device comprising: means defining a tubular discharge duct having a longitudinal extent; and a wall having a plurality of openings therethrough mounted in the discharge duct, the wall extending longitudinally in the duct with said openings opening transversely to the duct, said wall concurrently dividing the fluid flow and cooperating with the duct to direct the stream outwardly from the discharge duct, the wall openings acting on the fluid to cause a turbulent reduction in the longitudinal velocity of the discharging fluid stream, said duct defining a plurality of inwardly extending projections located on the inner surface of the duct adjacent to and cooperating with said wall openings in causing turbulent reduction in the longitudinal velocity of the discharging fluid stream.

10. For use in a fluid flow system for discharging a stream of fluid, an improved discharge device comprising: means defining a tubular discharge duct having a longitudinal extent; and a wall having a plurality of openings therethrough mounted in the discharge duct, the wall extending longitudinally in the duct with said openings opening transversely to the duct, said wall concurrently dividing the fluid flow and coooperating with the duct to direct the stream outwardly from the discharge duct, the wall openings acting on the fluid to cause a turbulent reduction in the longitudinal velocity of the discharging fluid stream, said duct being formed of molded synthetic resin and provided with integrally molded inwardly extending projections for causing turbulence in the fluid stream and cooperating with said wall openings in causing turbulent reduction in the longitudinal velocity of the discharging fluid stream.

11. A flow device for discharging fluid from an appliance and including a first end portion connected to said appliance for receiving fluid from said appliance and a second end portion for discharging said fluid into an open receptacle, said second end portion comprising: means defining a fluid passageway having inner wall surfaces defining a flow transition section; a plurality of projections defined on said inner wall surfaces for causing turbulence in the fluid flowing through said section; and wall means extending across said fluid passageway for dividing the stream of fluid entering said transition section into a plurality of portions and having a plurality of distributed inner apertures for concurrently reducing the velocity of the discharging fluid.

12. The flow device of claim 11 wherein said means defining a fluid passageway comprises a tubular conduit.

13. The flow device of claim 11 wherein said apertures are distributed over substantially the entire flatwise extent of the wall means.

14. The flow device of claim 11 wherein said wall means comprises a single integral folded wall element.

15. The flow device of claim 11 wherein said wall means comprises a plurality of substantially planar wall elements.

16. The flow device of claim 11 wherein said wall means comprises a plurality of substantially planer intersecting wall elements.

17. The flow device of claim 11 wherein said appliance comprises a dishwasher and said fluid comprises dish-treating liquid carrying a substantial amount of suspended particulate material, said flow device effectively avoiding clogging thereof by said suspended particulate material.

* * * * *